US005509941A

United States Patent [19]

Gurley

[11] Patent Number: 5,509,941

[45] Date of Patent: Apr. 23, 1996

[54] MORDANT COMPOSITION FOR NATURAL DYE PROCESSES

[75] Inventor: Sally Gurley, Boulder, Colo.

[73] Assignee: Allegro Natural Dyes LLC, Longmont, Colo.

[21] Appl. No.: 414,341

[22] Filed: Mar. 31, 1995

Related U.S. Application Data

[63] Continuation-in-part of Ser. No. 59,544, May 10, 1993, Pat. No. 5,403,362.

[51] Int. Cl.[6] ..... D06P 5/22; D06P 67/00; D06P 1/34

[52] U.S. Cl. ..... 8/625; 8/646; 8/595

[58] Field of Search ..... 8/646, 625, 595; 424/690; 423/629

[56] References Cited

U.S. PATENT DOCUMENTS

| | | | |
|---|---|---|---|
| 1,273,293 | 7/1918 | Warkup | 8/646 |
| 4,882,140 | 11/1989 | Becker | 423/629 |
| 5,221,289 | 6/1993 | Miyamatsu et al. | 8/646 |

OTHER PUBLICATIONS

Saje and Lewis, Jr., Hawley's Condensed Chemical Dictionary, 1981 no month available, pp. 46–47.

Bahl, D. et al., "Development of Dyeing Process of Silk with Natural Dye–cutch," Colourage (1988 no month available) 35(22):22–24.

Bliss, A., *A Handbook of Dyes from Natural Materials,* Charles Scibner's Sons, New York, pp. 38–39 (1981 no month available).

Crews, P., Part 1. "Considerations in the Selection and Application of Natural Dyes: Mordant Selection," Shuttle, Spindle & Dyepot (1981 no month available) 12:15, 62.

Garg, A. et al., "Effect of Mordants on Color of Natural Dye Extracted from Tessue Flowers (Butea mongsperma)," Colourage (1991 no month available) 38(3):50–53.

Greene, J., "Plant Dyes for Homespun Color," Horticulture (Aug. 1978) pp. 32–35.

Padhye, R. N. and Rathi, D., "Effect on Mordant Dyeing of Cotton with Vegetable Dyes," Textile Dyer & Printer (1990 no month available) 23(25):27–28.

Rama, S. J. and Gupta, K. C., "Parijataka–a good source of dye for woolens," Textile Dyer & Printer (1990 no month available) 23(25):27–28.

Sauvé, P. M., "Natural Dyes in Quebec," Color. Res. & Appl. (1981 no month available) 6:172–173.

Sayeed, A. et al., "Jute Fiber Dyeing with Catechu Tannic Acid and Catechin," Indian Textile J. (1990 no month available) 100(9):114–119.

Shenai, V. A. A. et al., "Studies on Natural Dyes, Part 2 Dyeing and Printing of Cotton Cloth with Ain Bark Extract by Suitable After–Treatments," Textile Dyer & Printer (1979 no month available) 12:29–31.

Smith, R. and Wagner, S., "Dyes and the Environment: Is Natural Better?", Amer. Dyestuff Rep. (1991 no month available) 80(9):32.

Vednere, S. et al., "Teak leaves and chir bark as natural dyes for wool," Colourage (1990 no month available) 37(20):48–49.

Simmons, M., "The Mordant process for the natural dyestuffs," in *Dyes and Dyeing,* Van Nostrand Reinhold Co. (1978 no month available) pp. 42–47.

*Primary Examiner*—Margaret Einsmann

*Attorney, Agent, or Firm*—Greenlee, Winner & Sullivan

[57] ABSTRACT

A mordant composition for dyeing fibers is provided which comprises a colloidal suspension of aluminum hydroxide in an aqueous medium. The composition is formed by adding an aluminum sulfate salt to sodium or potassium carbonate in aqueous solution at a weight ratio of about 7:1 aluminum sulfate salt to carbonate salt. The preferred aluminum sulfate salt is alum.

10 Claims, No Drawings

MORDANT COMPOSITION FOR NATURAL DYE PROCESSES

CROSS-REFERENCE TO RELATED APPLICATION

This application is a continuation-in-part of U.S. Application No. 08/059,544 filed May 10, 1993, now U.S. Pat. No. 5,403,362, incorporated herein by reference.

FIELD OF THE INVENTION

This invention lies in the field of mordant compositions used for natural dye processes.

BACKGROUND OF THE INVENTION

The use of synthetic dyes began with Perkin's accidental synthesis of mauvein ($C_{27}H_{24}N_4$) or "aniline purple" in 1856. Perkin was attempting to synthesize quinine, but recognized the commercial potential of mauvein as a synthetic dye. The synthetic dye industry was the major synthetic organic chemical industry in the early 1900's. Synthetic dyes have now virtually replaced natural or vegetable dyes in the textile industry, relegating natural dyes to use by hobbyists and cottage industries. The annual global sales of synthetic dyes are now estimated to be about $20,000,000,000.

Production and use of synthetic dyes produces serious toxic waste problems. The dye industry has recently attempted to reduce toxic effluents by recharging dye baths, using different dye techniques that are more efficient, recycling and recovering waste, and using computer technology to control the introduction of dyes and chemicals in the bath. Exhaustion rates have been improved in certain facilities to above about 65%; however, the average exhaustion rate remains about 40% and the synthetic dye industry continues to be a major source of pollution, discharging heavy metal salts and other toxic wastes into the environment.

Although the manufacture and use of synthetic dyes remains a major source of pollution, the commercial textile industry has rejected natural or vegetable dyes because such dyes are not reproducible and the dyed fabrics are not lightfast and washfast using present methods. Protein fibers, such as wool, are somewhat easier to dye than cellulosic fibers, and natural dyes are used commercially to a limited extent to dye protein fibers. Indigo remains in use for dyeing denim yarn. Cotton is the primary natural fiber used by the garment industry, accounting for nearly fifty percent of the fibers used. There is, however, no natural dye mordant process for dyeing cotton fibers, fabric or garments which results in a washfast and lightfast garment.

Natural dyes, such as indigo and madder, have been used since the beginning of recorded history; however, it is almost impossible using known techniques to obtain the same dye shade twice in succession with natural dyes, even using the same method. As noted by a major synthetic dye manufacturer, the color-giving molecules in the plants used for dyeing have not been "specifically designed by nature" for transfer to a substrate. Using prior natural dyeing processes, it is often necessary to choose conditions which severely damage the fiber to obtain a suitably dyed fabric. Further, it has not been possible to obtain dyed fabrics which are colorfast after washing and exposure to light, and it has not been possible to obtain a full palette of colors using natural dyes. Thus, the textile industry has generally rejected natural dyes for commercial applications.

The most commonly used mordants for natural dyes are potential sources of toxic waste. Mordants are chemicals that are necessary to chemically fix most natural dyestuffs. The mordant combines with both the dye molecule and the fiber molecule, producing a permanently fixed insoluble "color lake." The insoluble mordant-dye complex that is chemically combined with the fiber in a mordant-dyed fiber is referred to as a color lake. Color lakes are produced with adjective dyes (dyes that require mordant). Color lakes produced by reacting a dye with a metallic salt, such as madder (alizarin) with alum, were also used in inks and paints.

The most commonly used mordants for natural dyes are alum (potassium aluminum sulfate), chrome (potassium dichromate or potassium bichromate), blue vitriol (copper sulfate), ferrous sulfate, stannous chloride, sodium dithionite or sodium hydrosulfite, ammonium hydroxide, cream of tartar (potassium bitartrate), "Glauber's salt" (sodium sulfate), lime, lye (sodium hydroxide), oxalic acid, tannic acid, urea, vinegar (acetic acid) and washing soda (sodium carbonate, also known as soda ash). As will be understood by those skilled in the art, several of these mordants produce toxic waste, but the prior art has failed to produce permanently dyed cellulose fibers or fabric which are lightfast and washfast and which produce a wide range or palette of colors, even using heavy metal salt mordants.

Among the natural dyes long known to man are indigo, madder, cochineal, cutch and osage. The mordants used with natural dyes include chromium, aluminum, iron, copper, tin and other heavy metal and polluting salts. Madder is a vegetable dye produced from species of Rubia, herbaceous perennials grown in Europe and Asia. Preparations of dyes from madder root were used to produce red, yellow and brown colorations prior to the introduction of synthetic dyes. Cochineal is an insect dyestuff indigenous to Mexico which was in use by natives when the Spaniards invaded Mexico in 1518. The insect cochineal is the *Coccus cacti* which is cultivated in Mexico and Peru for producing carmine red. Stannous chloride was the principal mordant used with cochineal. Cutch or Catechu, also known as *Terra japonica*, is obtained from various species of mimosa, acacia and areca trees chiefly found in India, Southern Asia and Africa. The commercial dye product is an extract obtained by boiling the wood, trees, leaves and fruit and processing to produce a yellow or olive color, depending upon the mordant used. Osage is a yellow dye from the bark of the Bodark tree. Indigo is a blue dye from the leaves of the indigo plant. Traditionally, no mordants have been used with indigo dyes.

The methods of processing and preparing dye liquors from madder, cochineal, cutch, osage, indigo and other natural dye substances are well-documented in the literature.

There is an urgent need for a natural dye process and mordant composition which can meet the needs of the commercial textile industry, including a full palette of consistently reproducible natural colors which are lightfast and washfast. Further, there is an urgent need for a mordant which does not produce toxic wastes. The mordant composition of this invention meets both of these urgent needs.

SUMMARY OF THE INVENTION

The improved compositions of this invention comprise mordants useful in processes for dyeing fibers. Such fibers include, for example, cotton, linen and hemp fibers and fabrics and synthetic textiles which are often difficult to dye including nylon, Rayon, and Tensel. The improved nonpolluting mordant compositions of this invention are particularly, but not exclusively, suitable for dyeing natural cellulose fibers, including cotton and linen. Such fibers also include wood and other cellulosic materials. The mordant compositions of this invention are nonpolluting.

The compositions may be used to pre-condition the fibers for dyeing, or to condition fibers during dyeing so as to lead to improved and controlled acceptance by the fibers of the dye colors, and improved colorfastness when exposed to repeated laundering and sunlight.

The mordant compositions of this invention comprise colloidal suspensions of aluminum hydroxide in aqueous media. The term "colloidal suspension" as used herein refers to the fact that no precipitation out of the aqueous medium occurs for at least a day or two. The fibers take up most of the aluminum hydroxide which penetrates into the fibers; however, this is distinguished from precipitation of the composition onto the surface of the fibers. The suspension may be clear, exhibiting a Tyndall's cone effect typical of colloidal suspensions, or may be somewhat cloudy after being added to the dye machine or if the composition is extremely concentrated.

The mordant composition is formed by adding an aluminum sulfate salt, preferably potassium aluminum sulfate ($KAl(SO_4)_2.H_2O$), also known as alum, to a solution of sodium carbonate, or potassium carbonate, preferably sodium carbonate, also known as soda ash, at a ratio of aluminum sulfate salt to carbonate of about 7:1 by weight.

The concentration of aluminum in the suspension may be from as high as is possible to achieve without causing precipitation of the aluminum hydroxide, up to very low concentrations. E.g., the Al concentration may be at least as high as about 2.44% by weight of Al to weight of water. This concentrated composition can be diluted manyfold to form a composition having an Al concentration of about 0.003% by weight of Al to weight of water without loss of usefulness. The fibers take up the aluminum hydroxide even from very dilute solutions such that the amount of aluminum per gram of fiber is more important than the concentration of the mordant composition. A composition of this invention uses about 0.3% to about 3% wof soda ash and about 3% to about 30% wof.

A preferred mordant composition of this invention comprises a colloidal suspension of aluminum hydroxide in aqueous medium formed by adding about 10% wof alum and about 1.5% wof soda ash (sodium carbonate) to an aqueous medium. Another preferred mordant composition of this invention used as a second mordant treatment is formed using about 2% by weight alum and about 0.3% by weight soda ash. The term "wof" stands for "weight of fibers" and refers to the percent material added based on the weight of fibers to be dyed, as is standard in the industry. Unless otherwise specified, all weight percentages referred to herein are wof.

As is known to those skilled in the art, the amount of water used for dyeing is based on the weight of fibers, and the weight ratio of water to fibers to be dyed is called the liquor ratio. In general, liquor ratios in the art are about 10:1 to about 20:1, preferably about 15:1. Liquor ratios used in the art are suitable for use with this invention. The Al concentration varies from the maximum concentration which can be maintained in suspension in the colloidal suspension compositions of this invention to the least concentration which will be effective in mordanting, preferably the Al concentration in the suspension is between about 0.022% (by weight of Al as a percentage of the weight of the aqueous medium or water) and about 0.44%.

The components may be added simultaneously to the aqueous medium, or the alum may be added slowly, with agitation, to a solution containing soda ash. The components are mixed at a temperature high enough to keep the components in suspension, preferably between about 110° F. and up to, but preferably not including, boiling temperature. Preferably the temperature at which the mordant composition is formed is between about 120° and about 180° F.

The colloidal suspension may be added to a mordant bath containing fibers to be treated, or may be formed by adding the aluminum salt and soda ash or equivalent directly to an aqueous medium already containing the fibers to be treated.

The aqueous medium may be water, or may contain other substances, i.e. the compositions of this invention may also include dyes, preferably natural dyes such as indigo, madder, cutch, cochineal and osage orange, as well as other dyes known to the art. The dye is present at a concentration required to achieve the desired color, as is known to the art.

Such compositions may also comprise a weak solution of tannin for further setting the dye in the fabric. Preferably, tannin is present at a concentration between about 0.5% wof and about 5% wof, more preferably about 1% wof to about 3% wof.

The improved mordant compositions of this invention produce permanently dyed fibers and fabrics or textiles which are colorfast when exposed to light and washing, and can be used to produce a full palette of reproducible natural colors. Further, the mordant compositions of this invention do not require the use of heavy metal salts or iron and thus produce permanently dyed fibers in a wide range of colors without producing toxic waste. The mordant compositions of this invention allow use of significantly less energy than commercial dye processes. This invention thus solves the problems associated with prior natural dye processes and avoids the pollution and toxic waste problems associated with synthetic dyes.

DETAILED DESCRIPTION OF THE PREFERRED EMBODIMENTS

A preferred first mordant colloidal suspension of this invention is formed by adding alum and soda ash to a mordant bath containing fibers to be premordanted before dyeing, preferably cotton or linen garments, at a weight ratio of about 7:1 alum to soda ash. The mordant compositions of this invention may be used to pretreat (premordant) fibers to be dyed with synthetic or natural dyes, preferably indigo, cutch, madder, cochineal, osage orange, other natural dyes and combinations of natural dyes. The use of the mordant compositions of this invention with indigo is described in U.S. Pat. No. 5,378,246, incorporated herein by reference.

The amount of alum and soda ash used are also optimized depending primarily on the fiber used. More of the mordant composition or more concentrated suspensions are used with tightly woven or heavy fibers, and less concentrated suspensions are used with lighter knitted fabrics. The amount of mordant composition is also optimized depending on the shade desired to be achieved by the dye process. As is usual in the art of dyeing, amounts or mordant composition are adjusted as required.

In general in the dyeing art, when a deeper shade is desired, the dye process takes longer than when a light shade is desired; however, the mordant compositions of this invention allow dyeing to achieve dark shades in the same amount of time as to achieve light shades.

As discussed above, other aluminum sulfate salts may be substituted for alum. For example, aluminum sulfate ($Al_2(SO_4)_3$) may be used. In this case, it is possible to use one-third to two-thirds less aluminum salt than when alum is used. Sodium carbonate may also be substituted for potassium carbonate.

The pH of the mordant composition and the dye bath containing the mordant composition is preferably between about 3.5 and about 4.5.

In a preferred embodiment, the mordant composition of this invention which is a colloidal suspension may be formed by mixing alum and soda ash in an aqueous medium such as water. The concentration of alum used is about seven times the concentration of soda ash in weight percent. The suspension may be formed by first adding soda ash (sodium carbonate) to water to form an aqueous solution of soda ash. Alum (potassium aluminum sulfate) is then slowly added to the aqueous solution of soda ash while the solution is agitated. Alternatively both the alum and soda ash may be added simultaneously to the water, with agitation. The temperature of the aqueous medium should be high enough to allow the components to go into suspension and not precipitate out, preferably at least about 110° F., and more preferably at least about 120° F. This composition is used to pretreat fibers to be dyed, as follows:

The fibers to be dyed, which may be in the form of garments, pieces of textile, or yarn, preferably garments, are wetted out by agitating with a commercial wetting solution, e.g., "Ecowet"™, available from Southwest Chemical Corporation. Next the mordant composition is added, preferably at a temperature of about 110° F. to about 120° F., and the fibers are agitated in the mordant composition and heated to about 180° F. to about 185° F. The initial temperature at which the mordant is added should be 120° F. or less for level dyeing (i.e., avoidance of streaking). The fibers are then agitated in the mordant composition at the 180° F. to 185° F. temperature for about 15 to 20 minutes until the aluminum hydroxide is substantially exhausted onto the fibers. The dye machine is then drained, the fibers are preferably rinsed in warm water and optionally dried. The fibers are then ready for dyeing.

After again optionally wetting out the fibers, they are agitated in an aqueous solution of the natural dye liquor for a time sufficient to reach the desired temperature and for uptake of the dye. Generally, the aqueous medium in the dye machine will become noticeably clearer as the dye is exhausted onto the fibers. Suitable dye temperatures are known to the art. The dye bath is agitated at the appropriate temperature for about fifteen minutes.

A second mordant composition of this invention is then introduced, preferably a mordant composition of this invention utilizing one-fourth to one-third the concentration of alum and soda ash as the first mordant composition used to pretreat the fibers. The second mordant composition aids in fixing the dye, resulting in improved colorfastness. The amount used is generally dependent on the depth of shade, darker shades generally requiring a higher concentration or greater volume of the mordant suspension. Excess mordant can be added, i.e., up to half again as much as the minimum required to optionally set the dye, without adversely affecting the dye quality. The second mordant composition is preferably introduced near the end of the dye cycle and the fibers are agitated in the mordant and dye solution for about fifteen minutes at a temperature less than boiling and preferably about 180° F. to 185° F. Finally, the fibers are preferably agitated in a weak aqueous solution of tannic acid or tannin, which may be added to the dye bath containing the second mordant, or the dye bath containing the second mordant may be drained and the tannin treatment done in a separate step.

In an alternative process found to be useful for dyeing fibers (preferably with osage), the mordant composition of this invention may be added directly to the dye bath rather than being used for premordanting. The mordant composition may be added as a colloidal suspension in aqueous medium, or the soda ash and alum may be added separately directly to the dye machine containing fibers and dye in the dye bath. Preferably the soda ash is added first followed by the alum. An aqueous colloidal suspension is then formed directly in the dye bath. When the ingredients are added directly to the dye bath, the dye bath should optimally be at a temperature of at least about 150° F. and not more than about 170° F. Then the temperature is raised to about 180° F. to about 185° F. and the machine is agitated for about fifteen minutes. After the dye has exhausted onto the fibers, tannin can be added, without draining the dye machine, and agitated for about fifteen minutes.

In general, best results are achieved by premordanting the fibers prior to dyeing, whether garment dyeing, piece dyeing, range dyeing, or package dyeing. In the case of indigo, the fibers should be premordanted if it is desired to use a mordant.

The natural dye process using mordant compositions of this invention may be carried out in a conventional commercial or industrial washing machine or garment or piece dyeing machine. A computer-controlled industrial washing machine adapted for garment dyeing may be used, as it allows the operator to preprogram the introduction of fluids such as water into the washing machine chamber or basket, temperature and time, including wash and agitation cycles, etc. Further, it is possible to program an industrial washer to raise or lower the temperature while agitating the fibers as described herein. A suitable industrial washing machine for the dyeing processes using the mordant compositions of this invention is the Unimac Washer Extractor made by Unimac Corporation. The natural dye processes using mordant compositions of this invention, may, however, be adapted to existing professional garment dye machines.

The mordant dye process of this invention does produce consistent dyed textile pieces and garments in a wide range of natural colors. Further, the colors are washfast and lightfast. The American Association of Textile Colorists and Chemists has developed standardized tests to determine whether a dyed fabric is washfast (Test No. 61A) and lightfast (Test No. 16E). The potential score or index on such tests ranges from 0 to 5. The natural dye mordant process of this invention results in a dyed fabric which scores between 3 and 5 on such tests, equal to or greater than synthetic dyes on the same fabrics.

As will be understood by those skilled in the art, certain modifications can be made to the mordant compositions and natural dye processes using the mordant compositions of this invention within the purview of the appended claims. The colloidal suspension of aluminum hydroxide mordant compositions of this invention are not limited to use with the natural dyes mentioned herein, but effective compositions may be prepared using these mordant compositions in combination with other dyes. Further, other fibers than cellulose fibers may be dyed using these compositions. The compositions of this invention may be used with some synthetic yarns and fabrics. The compositions of this invention comprising mordant colloidal suspensions and dyes and/or tannin are all useful to produce improved dyed fibers or fabric. For example, the use of a final tannin treatment following the dye-mordant step resulted in a 10 to 20% improvement in washfastness and lightfastness. The use of an aqueous colloidal suspension of aluminum hydroxide resulted in a 20 to 40% improvement in washfastness and lightfastness tests, and the use of a second mordant treatment resulted in a further 10% improvement. As will be understood by those skilled in the art, these improvements were unexpected, particularly in view of the long history of the use of natural dyes and the replacement of natural dyes by synthetic dyes over a century ago.

Examples

Example 1. Preparation of Mordant Composition.

A mordant composition for pretreating about 9,100 g (about 20 lb) of cotton garments was prepared. Two percent of the weight of the fibers (182 g) of soda ash was added to five gallons of warm water and stirred to dissolve all the soda ash. Fifteen percent of the weight of the fibers (1,365 g) alum was then added slowly to the aqueous solution of soda ash to avoid flashing. The solution was then heated to about 150° and stirred to form a colloidal suspension of aluminum hydroxide in water.

Example 2. Pretreating of Fibers.

The garments of Example 1 were pretreated with the mordant composition of Example 1 as follows. The garments were first wetted out with warm water and 40 ml of "Ecowet" commercial wetting solution. The garments were then heated to 120° and one-half of the composition of Example 1 was added and the garments were agitated for ten minutes. The garments and mordant composition were then heated to 140°, the remainder of the mordant composition was added, and the garments were agitated in the mordant composition for an additional ten minutes. The aqueous mordant composition was then heated to 165° and agitated for an additional forty-five minutes. The garments and mordant composition were then cooled to 120°, drained, rinsed and dried.

Example 3. Cochineal Dyeing.

Cotton fibers in the form of garments were dyed with cochineal as follows: Twenty pounds (9,100 g) of cotton fibers in the form of garments premordanted as in Example 2 were wetted out with warm water containing 40 ml of "Ecowet solution". One gallon (2.79 liters) of water containing cochineal dye extract was added to the wetted out fibers and heated at two degrees per minute to 165°. The fibers were then agitated in the aqueous dye solution for thirty-five minutes. A second aqueous mordant composition containing 0.3% weight of fibers (27.3 g) soda ash and 2% weight of fibers (182 g) alum was added and the fibers were agitated for fifteen minutes. The second mordant composition formed a colloidal suspension comprising aluminum hydroxide. The mordant composition was then drained and an aqueous solution containing 1% weight of fibers (91 g) tannin was added to the chamber. The chamber was then heated to 140° F. and agitated for ten minutes. The tannin solution was then drained, the fibers were washed with detergent, rinsed and dried. Liquor ratios of 15:1 were used for all steps.

Example 4. Osage Dyeing.

Twenty pounds of cotton garments were placed in the chamber of a commercial garment dye machine, water was added to the machine at a liquor ratio of 15:1. Osage dye solution prepared from raw osage wood using 15% osage wood wof was added to the machine, followed by addition of 10% wof alum and 1.5% wof soda ash, which were added to the chamber when the temperature reached 150° F. without being predissolved, to form a colloidal suspension of aluminum hydroxide in situ. The temperature was raised to 160° F. and kept there for 10 minutes, then raised to 180° F. and kept at that temperature for 15 to 20 minutes as the chamber was agitated. Tannin was added at 1.5% wof. The chamber was then drained and the fibers washed.

I claim:

1. A composition comprising a mordant for dyeing fibers which is a colloidal suspension of aluminum hydroxide in aqueous medium formed by adding an aluminum sulfate salt to sodium or potassium carbonate in aqueous solution at a weight ratio of about 7:1 aluminum sulfate salt to carbonate salt, wherein the aluminum concentration in said suspension is between about 0.003 to about 2.44 weight percent of water.

2. The composition of claim 1 made using alum as the aluminum sulfate salt.

3. The composition of claim 2 made using sodium carbonate.

4. The composition of claim 1 wherein said suspension is formed at a temperature of at least about 110° F. to less than boiling.

5. The composition of claim 1 also comprising a natural dye in an amount effective to dye said fibers.

6. The composition of claim 5 wherein said dye is selected from the group consisting of madder, cutch, cochineal, and osage.

7. The composition of claim 6 also comprising tannin in an amount effective to improve fastness of said dye in said fibers.

8. The composition of claim 1 comprising between about 0.022 and about 0.44 weight percent Aluminum to water.

9. The composition of claim 1 also comprising fibers and having a liquor ratio of between about 10:1 and about 20:1.

10. The composition of claim 9 made with about 0.3% to about 3% soda ash and about 3% to about 30% wof alum.

* * * * *